United States Patent [19]

Rockerath

[11] 4,333,409

[45] Jun. 8, 1982

[54] FABRIC LABEL FEEDING MEANS

[75] Inventor: John L. Rockerath, Utica, N.Y.

[73] Assignee: Cluett, Peabody & Co., Inc., New York, N.Y.

[21] Appl. No.: 106,013

[22] Filed: Dec. 21, 1979

[51] Int. Cl.[3] ..... D05B 35/06

[52] U.S. Cl. ..... 112/121.27; 112/130; 112/152; 112/320; 156/DIG. 33

[58] Field of Search ..... 112/152, 130, 121.27, 112/290, 121.26, 320; 156/DIG. 33, DIG. 28

[56] References Cited

U.S. PATENT DOCUMENTS

| | | | |
|---|---|---|---|
| 1,966,903 | 7/1934 | Piepenbring et al. | 156/DIG. 33 |
| 3,304,897 | 2/1967 | Rubin | 112/290 X |
| 3,680,509 | 8/1972 | Miller | 112/152 |
| 3,972,296 | 8/1976 | Marforio | 112/121.27 |
| 4,067,273 | 1/1978 | Marforio | 112/152 X |

*Primary Examiner*—Peter P. Nerbun

*Attorney, Agent, or Firm*—James F. Bryan

[57] ABSTRACT

A fabric label feeding apparatus for use in a stitching process including a roll of continuous labels in strip form, a feeding cylinder for engaging a raised stitch incorporated in each individual label and cut-off means for separating individual labels from the label strip.

6 Claims, 9 Drawing Figures

FABRIC LABEL FEEDING MEANS

BACKGROUND OF THE INVENTION

The present invention consists of improved means for label feeding where the labels are to be sewn into or as an adjunct to a fabric part. Various means have been devised for label feeding, and generally speaking such devices have been fairly complicated. Examples of such prior art teachings showing the state of the art may be found in U.S. Pat. Nos. 2,560,186; 3,111,920; 3,482,537; 3,611,959; 3,766,870; 3,812,800; and 4,030,429. The present invention seeks to avoid most of the complexity of the foregoing prior art devices by the use of a reciprocating label feed rod which quite simply and effectively pushes a continuous tape comprising a plurality of individual labels toward and into the throat of a sewing machine. By means which shall be described, the incremental movement of the tape is precisely controlled in cooperation with cutting means for separating individual labels from the tape strip.

SUMMARY OF THE INVENTION

In accordance with the present invention, there is provided a fabric part label feed apparatus comprising a tape strip consisting of discrete individual labels joined end to end, storage means for said tape strip, means for removing said tape strip from said storage means, a sewing station, means for supporting and guiding said strip toward said sewing station, a feed rod reciprocable toward and away from said supporting and guiding means, means attached intermediate each of said labels for engagement with said feed rod, means for causing said feed rod to reciprocate to engage said strip and to advance said strip toward said sewing station, means for receiving said strip adjacent to said sewing station and for feeding a label therefrom into and through said sewing station, and cutting means operating in conjunction with said label feed rod to sever in sequence individual labels from said strip immediately prior to an individual label being fed into said sewing station.

DESCRIPTION OF A PARTICULAR EMBODIMENT

Figure 1:
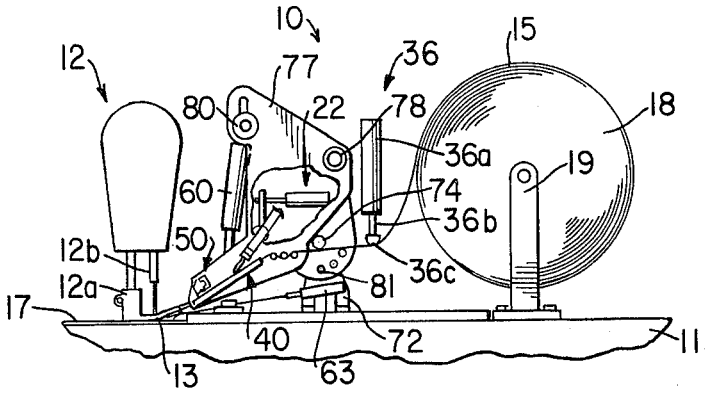
FIG. 1 is a side elevation of the apparatus of the present invention with portions thereof broken away.

Referring now to the drawing and initially to FIG. 1 thereof, a label feed and pocket hemmer apparatus 10 constructed according to the principles of the present invention has been illustrated.

Figure 2:
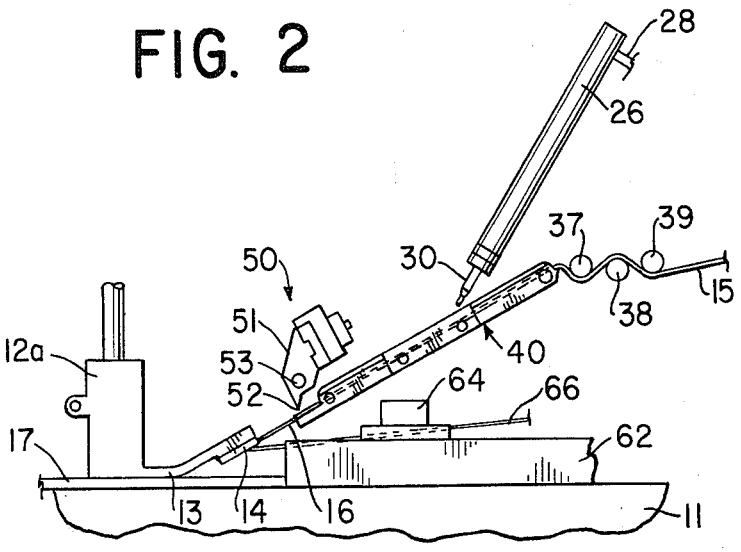
FIG. 2 is an enlarged portion of the device as shown in FIG. 1.
Figure 3:
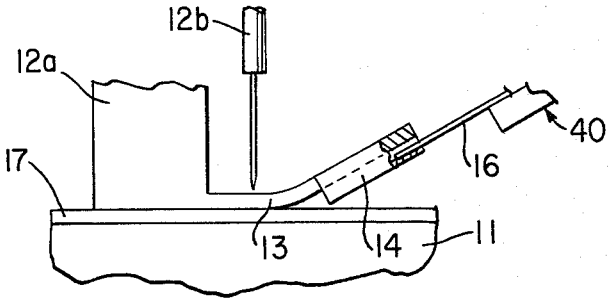
FIG. 3 is a further enlargement of a portion of the device as shown in FIG. 2.

The apparatus 10 includes a table 11 upon which is mounted a sewing machine 12 having a conventional presser foot **12*a* and a needle and needle bar 12*b*. Referring to FIGS. 2 and 3, it will be seen that mounted to the under surface of the receiving end 13 of the presser foot 12*a* is channel member 14. The latter is adapted to receive a label 16 which passes beneath the presser foot 12*a* and is sewn into a garment part 17. Label 16 is part of a continuous attached label cape 15 wound in a roll 18 supported for rotation in a roll carrier 19 bolted to the table 11**.

Figure 6:
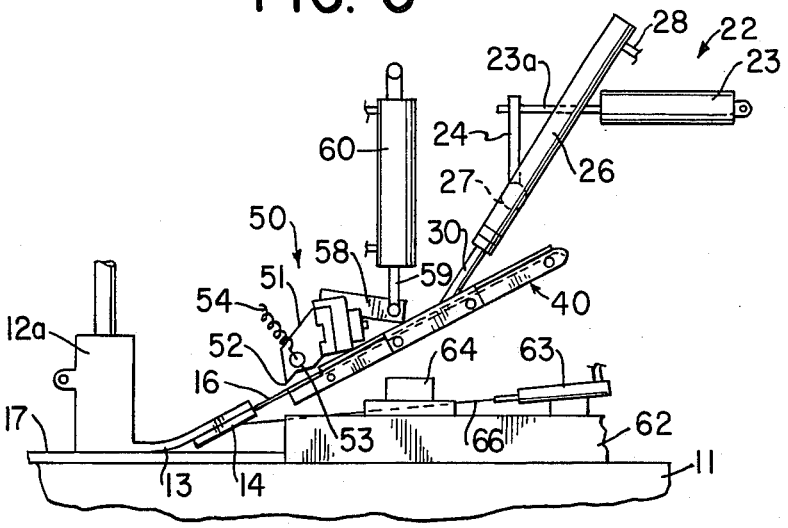
FIGS. 6–8 are side views similar to FIG. 2 showing the sequential actuation of the cutter and label feed portions of the apparatus of the present invention.
Figure 7:
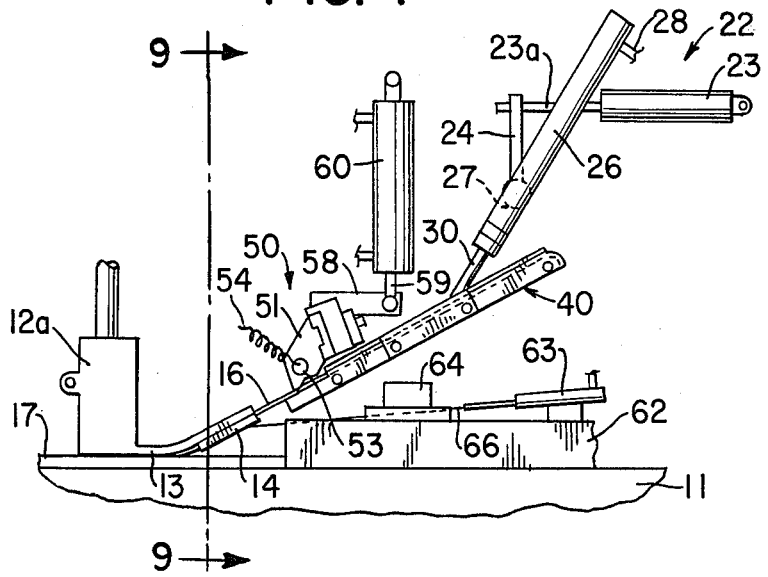
Figure 8:
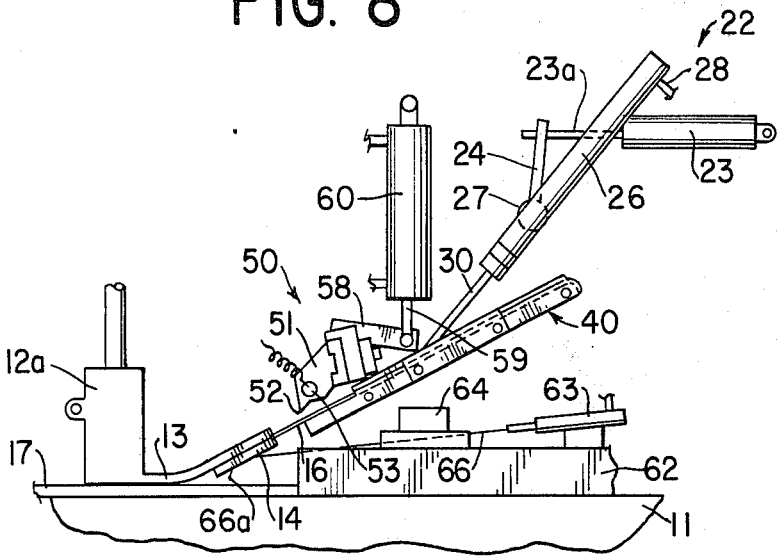

Mounted to a vertical frame section 20 is a label feed cylinder assembly 22. As best seen in FIGS. 6–8, the label feed cylinder assembly comprises an air operated actuator 23, a plunger **23*a*, a second arm 24 carried by plunger 23*a* and a label feed cylinder 26. The latter is pivotally attached to frame 77 at 27, the pivotal attachment being connected to arm 24 so that reciprocation of plunger 23*a* will cause rotation of label feed cylinder 26. Cylinder 26 is air actuated to cause reciprocation of the label feed rod 30 which is spring biased toward the air inlet end 28 of the cylinder 26**.

Figure 4:
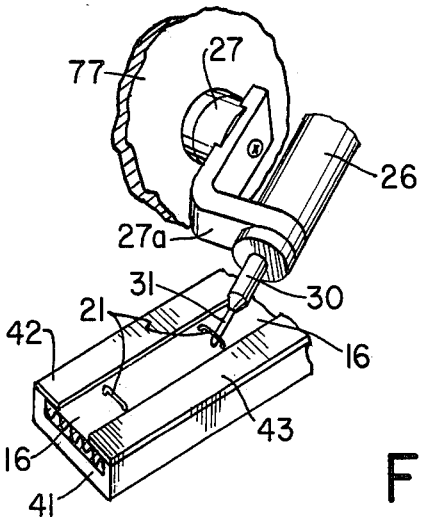
FIGS. 4 and 5 are alternate embodiments of label tapes and feed mechanisms therefor which may be used in accordance with the present invention.
Figure 5:
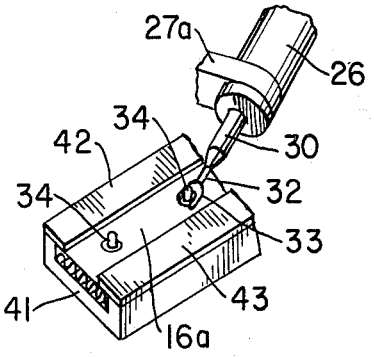

As seen in FIG. 4, the end of the label feed rod 30 has a pin-like projection 31 which is adapted to engage within successive ones of loops 21 located intermediate each of the labels 16. Alternatively (see FIG. 5), label feed rod 30 is joined to a pin 32 having a U-shaped member 33 connected thereto for engagement of the male portion of snap fastener element 34. Thus, in each of the forms shown in FIGS. 4 and 5, the end of the label feed rod is adapted to engage respectively a loop 21 or a fastener element 34 when the rod 30 is actuated to move the label tape 15 toward the sewing machine 12.

As will be seen with reference to FIG. 1, the label tape 15 passes from the roll 18 beneath label stripper 36 (whose function will be described) around friction rods 37, 38, 39 (FIG. 2) and enters label guide 40 (FIG. 4). Label guide 40 comprises a U-shaped channel 41 and members 42, 43. Label feed cylinder 26 is initially in the position of FIG. 6. FIG. 7 shows the rod 30 partially extended from the cylinder and in engagement with either a loop 21 or snap element 34. FIG. 8 shows the feed rod fully extended. It will be noted that cylinder 26, due to the action of rod 30, will be caused gradually to rotate clockwise. Rod 30 will be withdrawn after the sequence just described, and air actuator 23 will effect counterclockwise rotation of cylinder 26 to return it to the position shown in FIG. 6.

Referring to FIG. 1, it will be seen that label stripper 36 consists of actuating cylinder **36*a* and rod 36*b*, the latter having an enlarged end portion 36*c*. Rod 36*b* will be caused to depress a portion of the tape stripper 15 in sequence with and while the label feed rod 30 is in engagement with one of the respective loops 21. This will cause the tape strip to be feed or unwound incrementally from roll 18**.

At the exit end of the label guide 40 there is a label cut-off device 50. The device 50 comprises a cutting head 51 having a cutting edge 52, the head 51 housing a heating element 53 energized by the electrical connection 54. The head 51 rotates upon a journal 56, the latter being secured in a yoke 57 (see FIG. 9). Connected to the head 51 is an arm 58, one end of which is pivotally connected to rod 59 of an actuator 60. Thus, when rod 59 reciprocates due to energization of its actuator 60, arm 58 causes movement of the cutting edge 52 toward and away from the label guide 40.

Referring to FIG. 8, it will be seen that mounted upon a fabric part folder 62 there is an assembly consisting of members 63, 64 which support a spring steel guide 66, the latter extends as at 66*a* almost into contact with the receiving end 13 of the presser foot 12*a* so that labels 16 are held between the underside of the receiving end 13 and the upper surface of the guide end 66*a*. Thus, individual labels 16 immediately prior to cut off from the tape strip 15 will be fed by the device of the invention into the presser foot 12 at the intermediate receiving end 13 through the guide end 66*a*.

Figure 9:
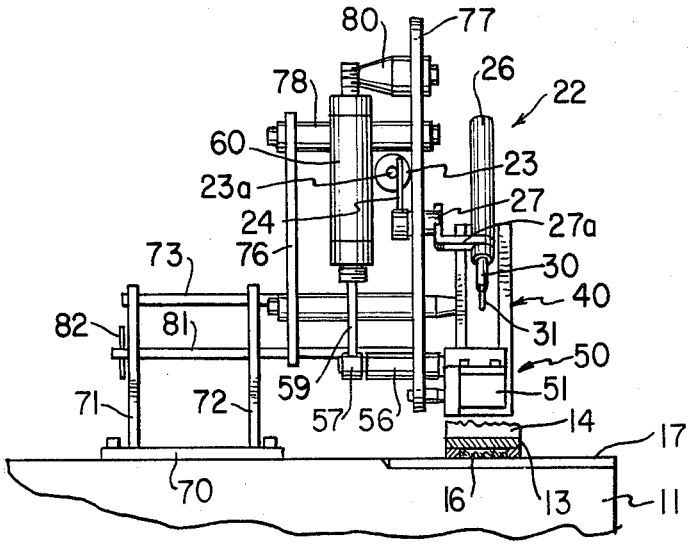
FIG. 9 is a view taken in the direction of arrows 9—9 of FIG. 7.

Referring to FIG. 9, it will be seen that the various portions of the mechanism thus far described are mounted upon the table 11 by the means shown in this figure. Essentially, the base support comprises mounting plate 70 to which is affixed a double yoke 71, 72. Horizontal rod 73 passes through the upper ends of yoke 71, 72 extending laterally to join and to support a journal 74. Yoke members 76, 77 are rotatable about journal 74 and are joined at their upper ends by rod 78. Label feed cylinder 26 is connected to yoke 77 by means of bracket 27*a* and rotatable pin 27. Actuator 60 is secured at its upper end to yoke 77 by bracket 80.

Yoke member 76 has at its lower extremity a series of equally spaced drilled holes (not shown) arranged arcuately along the bottom edge thereof and are drilled to slidingly accept lock rod 81 which is manually operable into and out of selective ones of the arcuately drilled holes by means of a pull push rod 82 mounted transversely to the axis of lock rod 81.

Referring now to FIGS. 6, 7 and 8, it will be noted that all the elements mounted on or attached to yoke members 76, 77 and in particular cut-off device 50 is mounted in close proximity to receiving end 13 of presser foot 12*a* and also needle bar 12*b*. When adjustments are called for in this area, or if the sewing machine must be removed, the components mounted on or attached to yoke members 76, 77 can be removed from this area by being pivotally swung away therefrom by pulling out lock rod 81 and rotating the yoke members 76, 77 sufficiently to accomplish this removal and locked in a new position by inserting lock rod 81 into a successive one of the holes (not shown) in yoke 76.

It will be understood that the foregoing description has been representative and that in order to understand fully the scope of the invention, reference should be made to the appended claims.

I claim:

1. A fabric part label feed apparatus comprising a tape strip consisting of discrete individual labels joined end to end, storage means for said tape strip, means for removing said tape strip from said storage means, a sewing station, means for supporting and guiding said strip toward said sewing station, a feed rod continuously reciprocable through a work stroke of predetermined length toward and away from said supporting and guiding means and operable to engage said strip during each movement of said feed rod toward said supporting and guiding means during the continuous reciprocation of the feed rod to continously advance said strip incrementally toward said sewing station, means for receiving said strip adjacent to said sewing station and for feeding a label therefrom into and through said sewing station, and cutting means operating in conjunction with said label feed rod to sever in sequence with the continuous reciprocation of the feed rod individual labels from said strip immediately prior to an individual label being fed into said sewing station.

2. The apparatus according to claim 1 wherein means attached intermediate each of said labels for engagement with said feed rod is a loop extending transversely over said tape strip, the ends of the loop attached to said strip adjacent to opposite sides thereof.

3. The apparatus according to claim 1 wherein said cutting means includes heating means to assist the cutting severing means in respective labels from said tape strip.

4. The apparatus according to claim 1 wherein said label feed rod is connected to the plunger of a fluid operated cylinder, said cylinder is mounted for rotary movement with respect to said supporting and guiding means to cause said strip to advance toward the sewing station when said feed rod engages the means attached intermediate each of said labels.

5. The apparatus according to claim 1, further characterized by means attached intermediate each of said labels for engagement with said feed rod upon engagement of the feed rod with said strip.

6. The apparatus according to claim 5, wherein said means attached intermediate each of said labels for engagement with said feed rod comprises a snap fastener attached to said label.

* * * * *